United States Patent [19]

Lockwood

[11] Patent Number: 4,561,199

[45] **Date of Patent: * Dec. 31, 1985**

[54] COMBINATION SPACER AND LIFTING DEVICE FOR MACHINERY INCORPORATING A BUCKET

[76] Inventor: Michael W. Lockwood, 623⅓ E. Haley St., Santa Barbara, Calif. 93103

[ * ] Notice: The portion of the term of this patent subsequent to Jan. 29, 2002 has been disclaimed.

[21] Appl. No.: 671,171

[22] Filed: Nov. 13, 1984

Related U.S. Application Data

[63] Continuation-in-part of Ser. No. 454,661, Dec. 30, 1982, Pat. No. 4,495,717.

[51] Int. Cl.[4] ..... E02F 3/76

[52] U.S. Cl. ..... 37/117.5; 37/DIG. 3; 37/DIG. 12; 414/724; 414/912

[58] Field of Search ..... 37/117.5, DIG. 3, DIG. 12; 414/722, 724, 912; 294/82 R

[56] References Cited

U.S. PATENT DOCUMENTS

| | | | |
|---|---|---|---|
| 2,402,352 | 6/1946 | Taylor | 37/DIG. 3 |
| 2,515,571 | 7/1950 | Siler | 294/82 R X |
| 3,501,817 | 3/1970 | Bambenek et al. | 294/82 R X |
| 3,587,887 | 6/1971 | De Carli | 414/724 X |
| 3,596,996 | 8/1971 | Carter | 37/117.5 X |
| 3,702,712 | 11/1972 | Cairns, III | 37/117.5 X |
| 4,204,348 | 5/1980 | Lydle | 37/117.5 |
| 4,242,035 | 12/1980 | Hornstein | 37/117.5 X |
| 4,320,561 | 3/1982 | Muller | 294/82 R X |
| 4,425,072 | 1/1984 | Lewis | 37/117.5 X |
| 4,495,717 | 1/1985 | Lockwood | 37/117.5 |

FOREIGN PATENT DOCUMENTS

| | | | |
|---|---|---|---|
| 2514070 | 3/1975 | Fed. Rep. of Germany . | |
| 711239 | 1/1980 | U.S.S.R. | 414/724 |

*Primary Examiner*—Edgar S. Burr
*Assistant Examiner*—Moshe I. Cohen
*Attorney, Agent, or Firm*—William W. Haefliger

[57] ABSTRACT

A combination spacer and lifting device for backhoe machinery, wherein the device includes a spacer defined by an elongated tubular sleeve member which may be formed to have an extended tab member fixedly attached thereto. The sleeve member is positioned as a spacer between the hydraulic-cylinder link members, and is rotatably mounted on the link pin which pivotally connects the link members to the bucket of the backhoe. A hook member is connected to the extended tab member of the sleeve, providing a means by which a chain, cable or the like can be readily attached so as to carry or lift a given load or structure; and the hook is oriented to prevent interference with a bucket lifting arm.

12 Claims, 7 Drawing Figures

COMBINATION SPACER AND LIFTING DEVICE FOR MACHINERY INCORPORATING A BUCKET

This application is a continuation-in-part of my prior application Ser. No. 454,661, filed Dec. 30, 1982, now U.S. Pat No. 4,495,717.

BACKGROUND OF THE INVENTION

1. Field of the Invention

This invention relates generally to a lifting device, and more particularly to a combination spacer and lifting device, for use with a backhoe having a typical bucket.

2. Description of the Prior Art

As is well known in the art, various problems and difficulties are being encountered in providing suitable means for using a backhoe machine as a lifting device for an on-the-job crane mechanism. That is, very often there is a need to lift or move a load or structure where only a backhoe device is available. The backhoe is mainly designed to dig trenches and to perform like operations by means of a hydraulically operated bucket which is generally provided with digging teeth along the leading edge thereof. These teeth have been used to lift loads or structures, but in many cases with very limited success. Chains and cables are sometimes employed by wrapping them around the bucket, and this has not produced the best results.

Accordingly, there is a need for a lifting device that can be simply attached to a backhoe unit without requiring changes to the backhoe or bucket, and can be left in place as a functional part of the machine.

Known prior patents include the following:

U.S. Pat. No. 3,702,712 to Cairns discloses a ripper tooth for a backhoe; it suggests no hook hanging downwardly close to his bucket surface between his plates 2 and 3, to allow hook pivoting, and it has no chain whatsoever;

U.S. Pat. Nos. 3,501,817 to Bambenek, 4,320,561 to Muller, and 2,515,571 to Siler merely show hooks per se, and not in any relation to lifting buckets;

U.S. Pat. No. 3,587,887 to De Carli merely shows a chain and hook supported by the boom of a bucket loader;

U.S. Pat. No. 3,596,996 to Carter discloses a ripper attachment to a backhoe;

U.S. Pat. No. 2,402,352 to Taylor discloses a hook and chains supported tongs attachment to a bulldozer;

U.S. Pat. No. 4,204,348 to Lydie discloses a ripper tooth attachment to a bucket;

U.S. Pat. No. 4,24,035 to Hornstein discloses apparatus to convert a loader bucket to a pallet loader, and has a chain extending about a bucket;

German Pat. No. 25 14 070 discloses ripper teetch attached to a bucket; and

Russian Pat. No. 711339 discloses a hook suspended by a chain attached to a bucket cutting edge.

SUMMARY AND OBJECTS OF THE INVENTION

The present invention has for an important object to provide a lifting device that can be simply and effectively attached to most backhoe units, so as to overcome all of the presently known problems associated with lifting loads or structures with the aid of a backhoe unit.

It is another object of the invention to provide a combination spacer and lifting device which is readily positioned between the hydraulic-cylinder link bars, and is adapted to be rotatably mounted to the link pin that connects the links with the bucket, thus becoming an integral part of the backhoe.

It is still another object of the invention to provide a combination spacer and lifting device that allows a backhoe unit to function in a fashion that is similar to that of a hydraulic crane.

It is a further object of the invention to provide a device of this type that comprises a cylindrical sleeve member which is formed with an extended tab to which a hook member is releasably attached whereby chains, cables and like attachments can be used.

A still further object of the present invention is to provide a device of this character that has relatively few operating parts, is easy to service and maintain, and is relatively inexpensive to manufacture.

A yet further object of the invention is to provide a hook connection to a sleeve which when pivotally attached to a lifting bucket, will not interfere with a bucket lifting arm when the bucket is in extreme lifting position.

Still a further object of the invention is to provide a device of this character that is simple and rugged in construction, yet accomplishes the desired results of a lifting device.

The invention is basically embodied in the combination that includes:

(a) an arm supported lifting bucket having two laterally spaced protruding plates which extend in vertical planes, said bucket having an outer surface which is convexly curved downwardly, and from a location between said plates, (b) a tubular sleeve extending laterally and having a lateral axis and confined endwise between said plates, and a pin extending laterally through the sleeve and carried by the plates so that the sleeve may rotate about the pin, (c) a hook having a stem pivotally attached to said sleeve to hang downwardly outwardly of but close to the bucket surface between said plates, (d) a load carrying line engaging and carried by said hook, the line extending downwardly relative to the hook to freely and variably engage said bucket curved surface as the bucket is lifted and lowered by said arm supporting the bucket, (e) the hook being free to pivot about said lateral axis while facing the bucket surface.

As will appear, the hook typically extends in a plane generally parallel to the bucket outer surface at one side of the sleeve as the bucket is lifted as defined in subparagraph (d) above. The hook may be suspended by a tab which is U-shaped, the tab arms attached to the sleeve at locations spaced about the sleeve lateral axis; and the tab itself may extend in a plane normal to, or at a slight angle from a plane normal to, the sleeve lateral axis.

Further, the hook may have an alternate position wherein it extends in a plane generally parallel to the bucket surface and between said plates at the opposite side of the sleeve as the bucket is lifted to an extensive elevated position and at times when the hook is free of the chain; and in that position is not interferred with by the bucket lifting arm due to its facing relation to the bucket surface.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
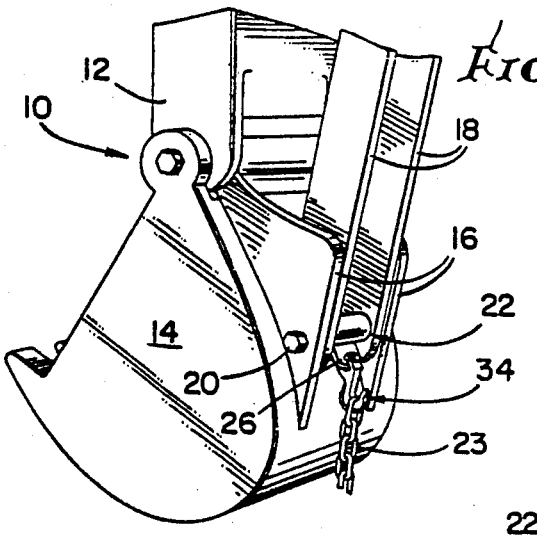
FIG. 1 is a pictorial view of a backhoe bucket illustrating the present invention being mounted between the hydraulic-cylinder links of the backhoe unit.

Referring more particularly to FIG. 1, there is shown a portion of a backhoe unit, generally indicated at 10. The portion illustrated includes the main supporting strut boom or arm 12 having a typical backhoe bucket 14 pivotally connected thereto. The bucket 14 is commonly provided with extended mounting plates 16 to which are pivotally connected a pair of hydraulic link bars 18. These bars are attached at their opposite ends to a hydraulic cylinder (not shown).

A pivot pin 20 of any suitable type is mounted so as to pass through plates 16 and link bars 18, a spacer member being generally positioned between the two opposing link bars.

Accordingly, in the practice of the present invention the normal spacer (not shown) is removed, and a combination spacer and lifting device, designated generally at 22, is inserted in place thereof, as seen in FIG. 1. Thus, such a device will enable the backhoe unit to be used in a manner similar to that of a hydraulic crane, whereby chains 23, cables, or like supporting devices, can be readily attached for moving or lifting loads or structures.

The present invention comprises a tubular sleeve or cylinder 24 having a wall structure of hardened steel of between $\frac{3}{8}''$ to $\frac{1}{2}''$ thick. The length of the sleeve should be determined by the space between the opposing link bars 18. Secured to sleeve 24 is a tab member 26. The tab can be secured in a suitable manner, either by welding as indicated at 28 or by forming the sleeve and tab as an integral unit such as by casting.

Tab 26 is preferably mounted longitudinally along the sleeve having a hole 30 disposed therein to receive mounting pin 32 which is used to mount and support a clevis-style hook 34. Hook 34 includes a yoke section 36, each yoke arm 38 having aligned holes 39. Thus, the yoke arms are arranged to straddle tab member 26, the pin 32 being secured by a cotter pin 40 in a well known manner.

Figure 2:
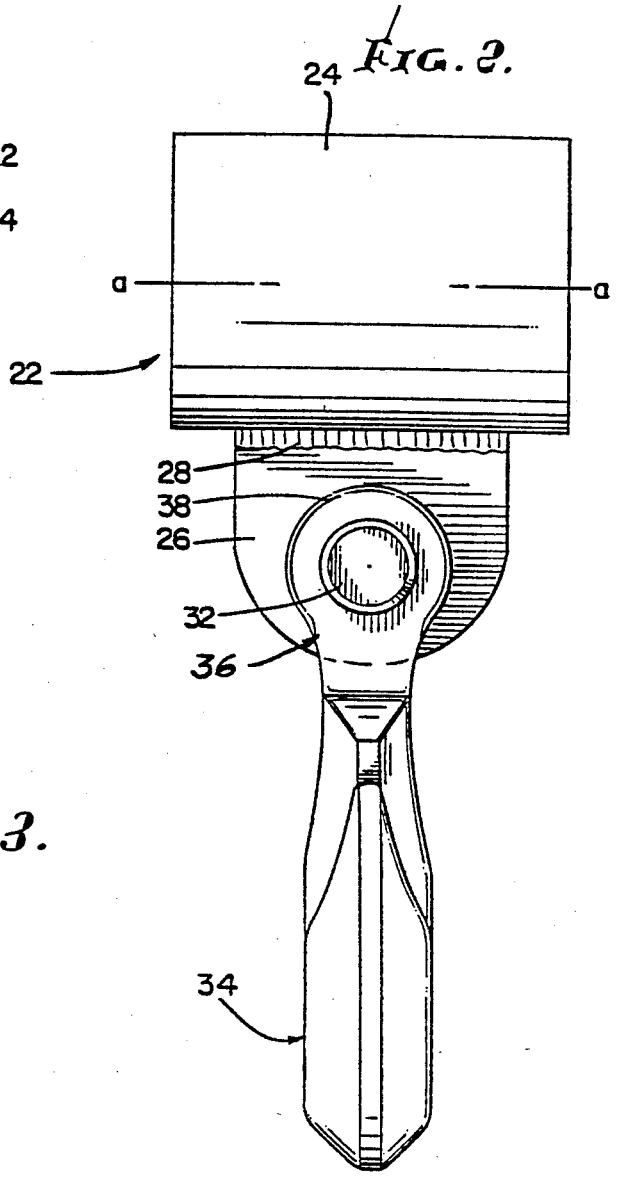
FIG. 2 is an enlarged front-elevational view of the lifting device.
Figure 3:
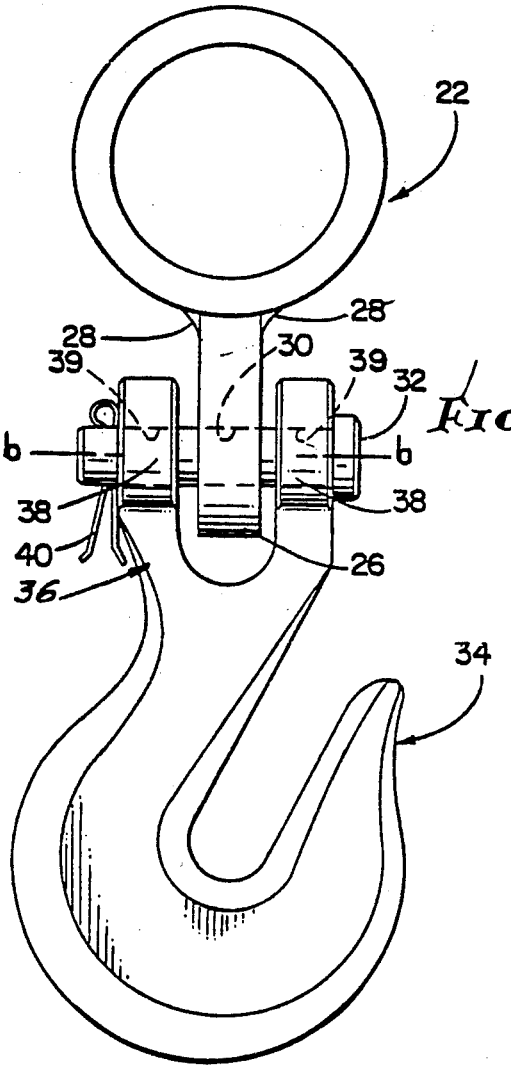
FIG. 3 is a side-elevation view of the lifting device.

Moreover, it is important to note the universal interconnection between the hook 34 and bucket 14, whereby sleeve 24 is adapted to rotate about the lateral axis a—a, asindicated in FIG. 2, and hook member 34 is adapted to rotate about the transverse axis b—b of mounting pin 32, as indicated in FIG. 3. This movement allows any imbalance to be corrected while a load is being raised.

Figure 4:
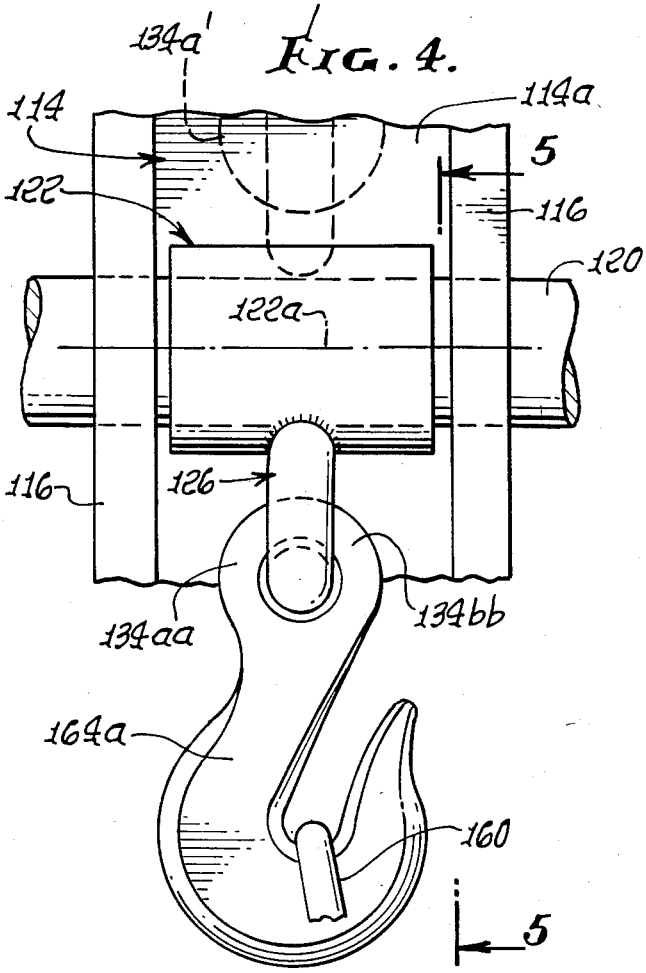
FIG. 4 is a side view like FIG. 3, showing a modification.
Figure 5:
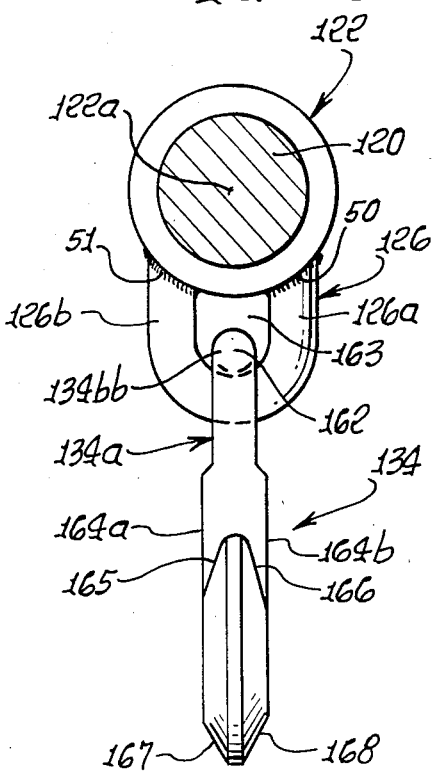
FIG. 5 is a frontal view taken on lines 5—5 of FIG. 4.
Figure 6:
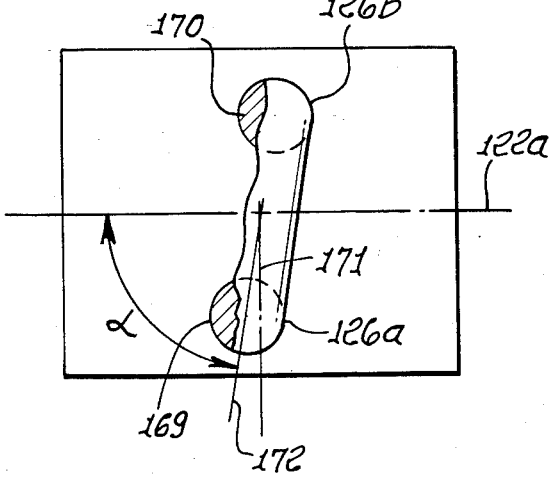
FIG. 6 is a frontal view of a modified connection to a sleeve.

Referring to FIGS. 4–6, the lifting bucket 114, as on a backhoe, has an outer surface 114*a* which is convexly curved downwardly, and from a location between two laterally spaced protruding plates 116, corresponding to the construction seen in FIG. 1. A tubular sleeve 122, made of steel for example, has a lateral axis 122*a* is confined endwise between the plates. A pin 120 extends laterally through the sleeve and is carried by the plates so that the sleeve may rotate about the pin, i.e. about the pin axis which is coaxial or nearly coaxial with the sleeve lateral axis. Sleeve 122 corresponds to sleeve 22.

A tab 126 is integral with the sleeve and extends downwardly therefrom, outwardly of the bucket surface. As shown, the tab is preferably U-shaped, and has two arms 126*a* and 126*b* which are connected to the sleeve at locations 50 and 51 which are spaced apart about the sleeve lateral axis 122*a*, as is clear from FIG. 5. As shown, the plane in which the tab projects (for example the plane of FIG. 5) extends normal, i.e. perpendicularly, to the axis 122*a*.

A hook 134 has a stem 134*a* pivotally attached to the tab to hang downwardly outwardly of close to the bucket surface 114*a* between the plates. As in FIG. 2, a chain typically has a link 160 engaging and carried by the hook, the chain extending downwardly to freely and variably engage the bucket curved surface as the bucket is lifted and lowered by the arm supporting the bucket. The hook stem 134*a* has two upwardly projecting yoke arms 134*aa* and 134*ab* forming a space therebetween, so as to extend about the tab lower extent, and pivot relative thereto. The pivotal connection allows pivoting about a lateral axis 162 which is formed by the hook stem extent 134*bb* passing through the tab opening 163, axis 162 extending generally parallel to the bucket surface 114*a*, and to sleeve axis 122*a*.

Accordingly, the hook has substantially flat opposite side faces 164*a* and 164*b*, one of which extends generally flatly toward the bucket surface. As shown in FIGS. 4 and 5, surface 164*b* faces surface 114*a*; and the broken lines 134*a*′ show the alternate position of the hook stem, at the upper and opposite side of the sleeve, wherein the opposite side 164*a* of the hook flatly faces toward and may engage the bucket surface 114*a*′ between plates 116. The hook may assume this position when not carrying a chain, and when the bucket is lifted to uppermost position. It is found that this hook position prevents destructive interference with the lifting arm 18 (see FIG. 1), as when the bucket is lowered from extreme up position. See also hook chamfers at 165–168 which assist this non-interfering relationship.

In FIG. 6, the tab is like tab 126 but its arms 126*a* and 126*b* are connected to the sleeve at locations 169 and 170 offset axially relative to a plane 171 normal to sleeve lateral axis 122*a*.

The plane 172 in which the tab projects extends at an angle $\alpha$ relative to lateral axis 122*a*, the angle $\alpha$ being between 80° and 90°, in order that the above described result or unusual advantage (non-destructive interference between the hook and arm) is realized.

Figure 7:
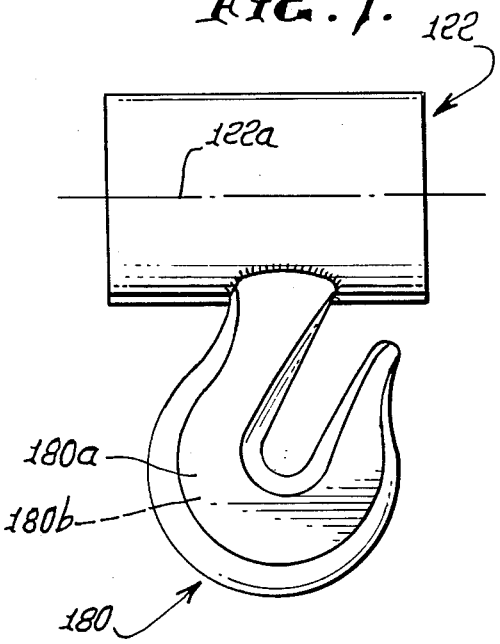
FIG. 7 is a view like FIG. 4, showing a further modification.

Referring to FIG. 7, the hook 180 is like hook 134, but is here directly connected to the sleeve 122, to pivot therewith about aleeve axis 122*a*. Thus hook opposite sides 180*a* and 180*b* may respectively flatly face the bucket surface in down and up pivoted positions of the hook, as described above.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. In combination (a) an arm supported lifting bucket having two laterally spaced protruding plates which extend in vertical planes, said bucket having an outer surface which is convexly curved downwardly, and from a location between said plates, (b) a tubular sleeve extending laterally and having a lateral axis and confined endwise between said plates, and a pin extending laterally through the sleeve and carried by the plates so that the sleeve may rotate about the pin, (c) a hook having a stem pivotally attached to said sleeve to hang downwardly outwardly of but close to the bucket surface between said plates, (d) a load carrying line engaging and carried by said hook, the line extending downwardly relative to the hook to freely and variably engage said bucket curved surface as the bucket is lifted and lowered by said arm supporting the bucket, (e) the hook being free to pivot about said lateral axis while facing the bucket surface.

2. The combination of claim 1 wherein the hook extends in a plane generally parallel to the bucket outer surface at one side of the sleeve as the bucket is lifted.

3. The combination of claim 2 wherein the hook has an alternate position wherein it extends in a plane generally parallel to the bucket surface and between said plates at the opposite side of the sleeve as the bucket is lifted to an extensive elevated position and at times when the hook is free of the chain.

4. The combination of claim 3 wherein the hook is integral with the sleeve.

5. The combination of claim 1 including connector means attached to the sleeve to project outwardly therefrom, and to which the hook is pivotally attached.

6. In combination (a) an arm supported lifting bucket having two laterally spaced protruding plates which extend in vertical planes, said bucket having an outer surface which is convexly curved downwardly, and from a location between said plates, (b) a tubular sleeve extending laterally and having a lateral axis and confined endwise between said plates, and a pin extending laterally through the sleeve and carried by the plates, so that the sleeve may rotate about the pin, (c) a tab integral with the sleeve and extending downwardly therefrom, outwardly of said bucket surface, (d) a hook having a stem pivotally attached to said tab to hang downwardly outwardly of but close to the bucket surface between said plates, (e) a chain having a link engaging and carried by said hook, the chain extending downwardly to freely and variably engage said bucket curved surface as the bucket is lifted and lowered by said arm supporting the bucket, (f) the stem having two upwardly projecting yoke arms forming a space therebetween, the tab projecting downwardly in a plane which is substantially normal to said lateral axis to extend between the yoke arms for pivotal connection therewith and about an axis which extends generally laterally and generally parallel to the bucket surface, (g) the hook having a side face which at times extends generally flatly proximate the bucket surface.

7. The combination of claim 6 wherein said plane in which the tab projects downwardly is normal to said lateral axis.

8. The combination of claim 7 wherein the plane in which the tab projects extends at an angle $\alpha$ between 80° and 90° relative to said lateral axis.

9. The combination of claim 6 wherein the hook extends in a plane generally parallel to said bucket outer surface and at one side of the sleeve as the bucket is lifted.

10. The combination of claim 9 wherein said tab is generally U-shaped.

11. The combination of claim 9 wherein the hook has an alternate position wherein it extends in a plane generally parallel to the bucket surface and between said plates at the opposite side of the sleeve as the bucket is lifted to an extreme elevated position and at times when the hook is free of the chain.

12. The combination of claim 10 wherein the U-shaped tab has arms which are connected to the sleeve at locations which are spaced apart about said lateral axis.

* * * * *